US007785119B1

(12) United States Patent
Chiang

(10) Patent No.: US 7,785,119 B1
(45) Date of Patent: Aug. 31, 2010

(54) AUDIO JACK CONNECTOR

(75) Inventor: Shu-Man Chiang, Taipei (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/581,140

(22) Filed: Oct. 18, 2009

(51) Int. Cl.
*H01R 29/00* (2006.01)

(52) U.S. Cl. ..... 439/188; 439/668

(58) Field of Classification Search ..... 439/188, 439/668, 669, 944
See application file for complete search history.

(56) References Cited

U.S. PATENT DOCUMENTS 5,879,197 A * 3/1999 Dewey ..... 439/668
6,551,127 B1 * 4/2003 Li et al. ..... 439/488
7,285,024 B1 * 10/2007 Tai ..... 439/668
7,371,125 B2 * 5/2008 McHugh et al. ..... 439/668
7,371,126 B2 * 5/2008 Lu et al. ..... 439/669

* cited by examiner

*Primary Examiner*—Khiem Nguyen

(57) ABSTRACT

An audio jack connector has an insulating housing defining a rectangular base. The base has a passageway passing therethrough for receiving an inserted audio plug connector. A channel is formed at a top surface of the base for communicating with the passageway. A set of switch terminals mounted to the insulating housing comprise an elastic terminal and a fixing terminal. The elastic terminal has a first top plate and a switch arm extended outward from the first top plate, with a free end thereof projecting into the passageway through the channel. The fixing terminal has a second top plate disposed above the channel. The second top plate has a pair of cantilever switch slices extending toward each other and perpendicular to an extending direction of the switch arm, with free ends thereof suspended over the free end of the switch arm and spaced from each other.

8 Claims, 4 Drawing Sheets

AUDIO JACK CONNECTOR

BACKGROUND OF THE INVENTION

1. Field of the Invention

The present invention relates to an audio connector, and more particularly to an audio jack connector having a structure of improving transmission quality of audio signal in application.

2. The Related Art

Conventionally, an audio jack connector mounted to an audio electronic device for transmitting electrical signals has an insulating housing, a plurality of conductive terminals and a set of switch terminals. The insulating housing has a passageway for receiving a mating audio plug connector, and a plurality of receiving recesses communicating with the passageway for receiving the conductive terminals and the switch terminals. The switch terminals are composed of a fixing terminal and an elastic terminal. The elastic terminal has a first base and a switch arm. The fixing terminal is provided with a second base and a switch slice. The switch arm and the switch slice locate in a side of the passageway. The switch arm is arranged at an outer side of the switch slice, with a gap formed therebetween. When the audio plug connector is mated with the audio jack connector, the switch arm will be pushed to contact the switch slice by the audio plug connector inserted into the passageway, for forming connection between the fixing terminal and the elastic terminal. However, the switch arm will deviate from original position because the audio plug connector is obliquely inserted into and rotated in the passageway. Since, generally speaking, the switch arm contacts the switch slice at a connecting point, the connection between the fixing terminal and the elastic terminal will be easily interrupted because of the improper contact between the switch terminals. Therefore, it is desirable and necessary to design an audio jack connector which is able to solve or at least overcome the problem mentioned above.

SUMMARY OF THE INVENTION

Accordingly, an object of the present invention is to provide an audio jack connector adapted for mating with an audio plug connector and capable of transmitting audio signal. The audio jack connector has an insulating housing defining a rectangular base. The base has a passageway passing therethrough for receiving the inserted audio plug connector. A channel is formed at a top surface of the base for communicating with the passageway. A set of transmitting terminals is received in the insulating housing. A set of switch terminals mounted to the insulating housing comprises an elastic terminal and a fixing terminal. The elastic terminal has a first top plate covered on the top surface of the base, and a switch arm extended outwards from the first top plate, with a free end thereof projecting into the passageway through the channel. The fixing terminal has a second top plate disposed above the channel. The second top plate has a pair of cantilever switch slices extending toward each other and perpendicular to an extending direction of the switch arm, with free ends thereof suspended over the free end of the switch arm and spaced away from each other. When the audio plug connector is inserted into the passageway, the free end of the switch arm is pushed to contact at least one of the free ends of the switch slices for forming an electrical connection between the fixing terminal and the elastic terminal.

As described above, the fixing terminal has two switch slices for contacting the switch arm of the elastic terminal. When the audio plug connector deflects in the passageway to make the switch arm, which restrains against the audio plug connector, deviate from original position, and the switch arm still contact at least one of the switch slices, which can form successive connections between the fixing terminal and the elastic terminal, consequently, insures steady transmission of the audio signals.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
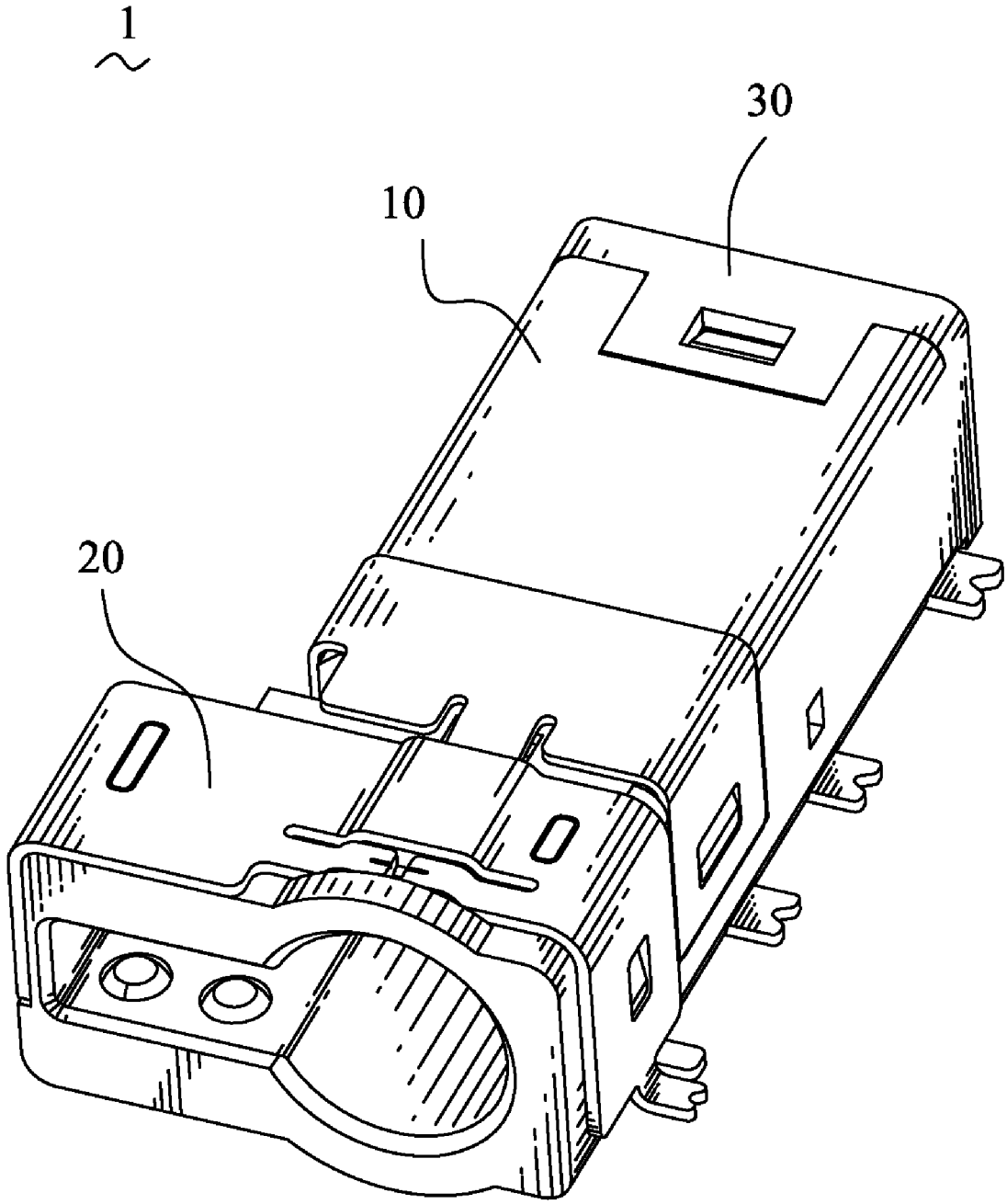
FIG. 1 is an assembled, perspective view of an audio jack connector of an embodiment in accordance with the present invention.

Referring to FIG. 1, an audio jack connector 1 according to the present invention is shown. The audio jack 1 comprises an insulating housing 10, a plurality of terminals 20 mounted to the insulating housing 10, and a cap 30 coupled with the insulating housing 10.

Figure 2:
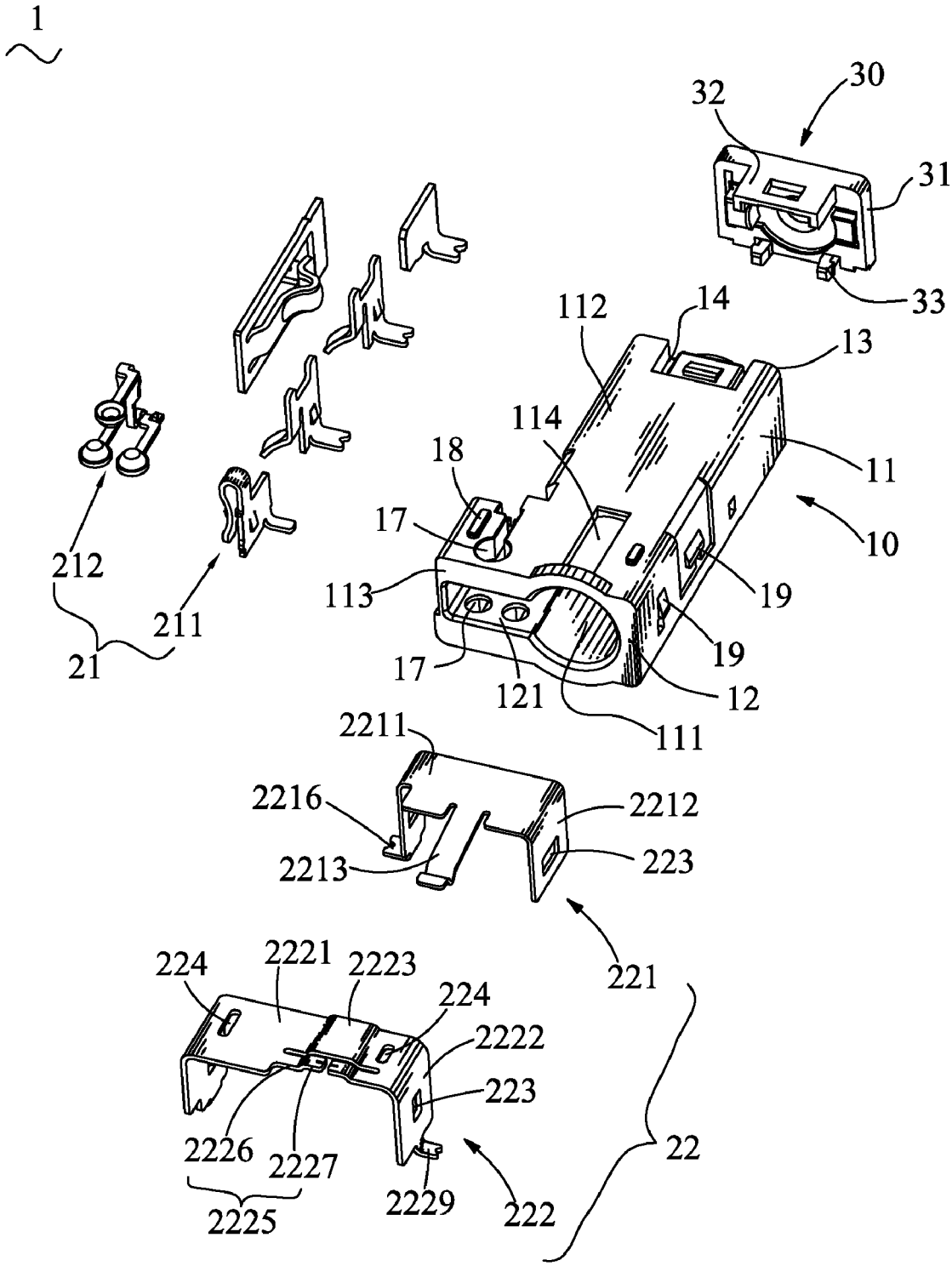
FIG. 2 is an exploded, perspective view of the audio jack connector shown in FIG. 1.
Figure 3:
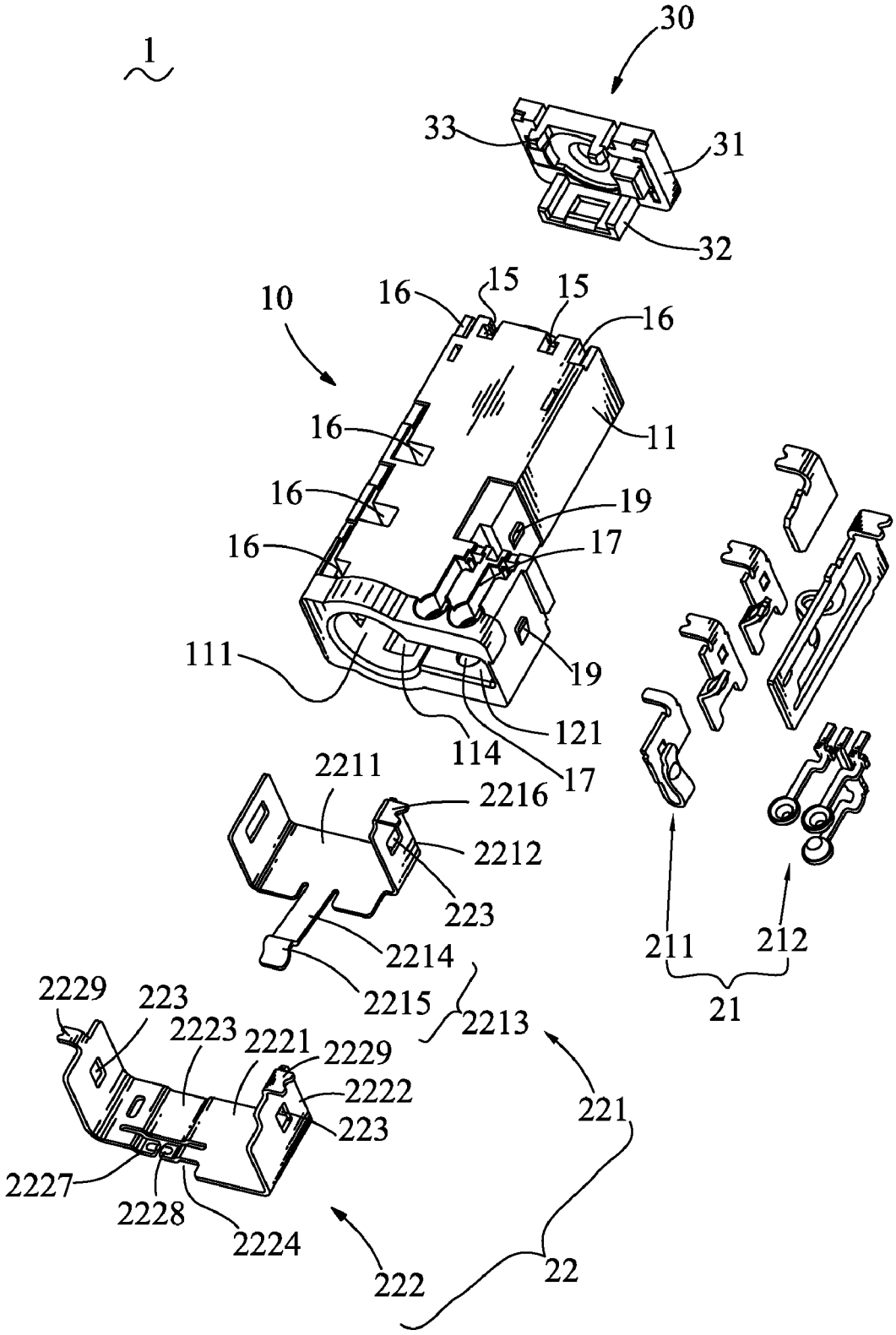
FIG. 3 is an exploded, perspective view the audio jack connector shown in FIG. 1 seen from another angle.
Figure 4:
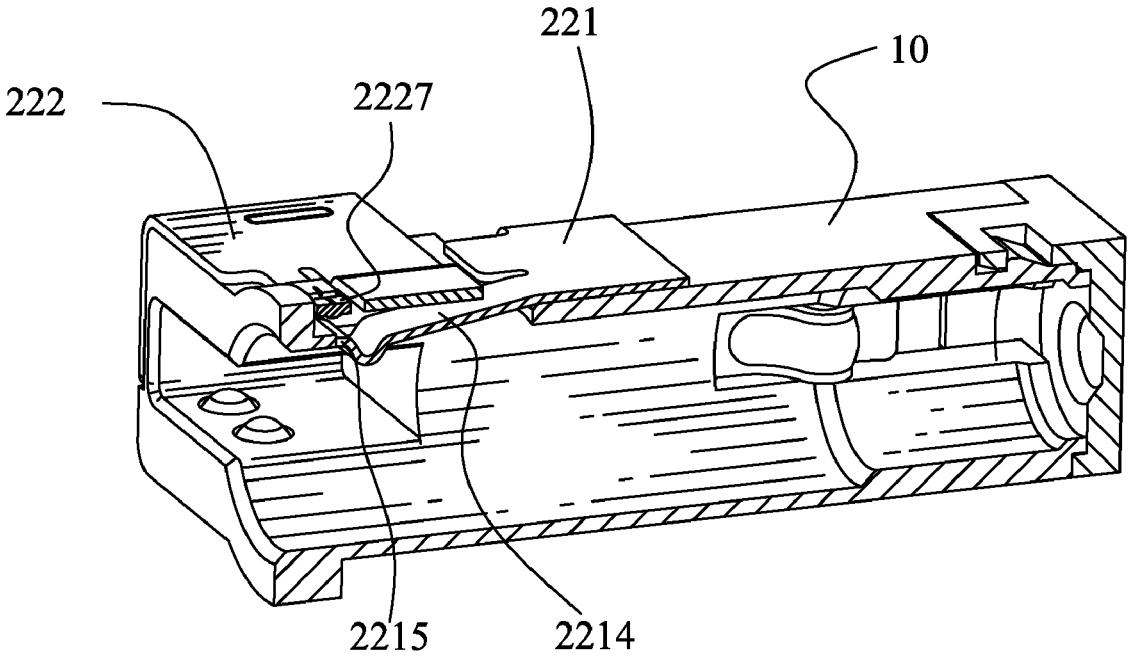
FIG. 4 is a cross-sectional view of the audio jack connector shown in FIG. 1.

With reference to FIGS. 2-4, the insulating housing 10 has a substantially rectangular base 11. The base 11 defines a first end 12, a second end 13 opposite to the first end 12, and a top surface 112 connecting with the first end 12 and the second end 13. A passageway 111, with a circular cross-section, is formed in the base 11 and passes through middle portions of the first end 12 and the second end 13 for receiving a mating audio plug connector (not shown). The first end 12 has a receiving recess 121 which is disposed at a side of the passageway 111 and communicates with the passageway 111. In this embodiment, an end of a side of the base 11 adjacent to the first end 12 is extended laterally to form a protrusion 113. The receiving recess 121 is recessed in the protrusion 113, with an opening formed at an end thereof which is flush with the first end 12. A top and a bottom of the protrusion 113 are formed with a plurality of second grooves 17 extending substantially perpendicular to the first end 12 for receiving charging terminals 212 of the terminals 20. The second end 13 has two hooking grooves 15. The hooking grooves 15 pass through a bottom of the base 11 and are spaced away from each other.

The top surface 112 of the base 11 has a rectangular buckling recess 14. The buckling recess 14 passes through the second end 13. The top surface 112 of the base 11 has two fixing lumps 18 spaced away from each other, and a rectangular channel 114 between the two fixing lumps 18. The fixing lumps 18 are arranged side by side and adjacent to the first end 12. The channel 114 extends along a direction perpendicular to the first end 12 and communicates with the passageway 111. The bottom of the base 11 is recessed with a plurality of first grooves 16 for receiving a set of audio terminals 211. Each of two opposite sides of the base 11 has two jamming lumps 19, adjacent to the first end 12, for fixing a set of switch terminals 22.

The terminals 20 is composed of a set of conductive terminals 21 and a set of switch terminals 22. The conductive terminals 21 have a plurality of audio terminals 211 and a plurality of charging terminals 212. The audio terminals 211 are inserted into the first grooves 16. The charging terminals 212 are mounted to the second grooves 17. The switch terminals 22 has an elastic terminal 221 and a fixing terminal 222, each of which may be bent with a metal plate to show a substantial door-frame shape.

Please refer to FIG. 2 and FIG. 3, the elastic terminal 221 has a rectangular first top plate 2211 and a pair of first lateral plates 2212 extended perpendicularly downwards from two opposite sides of the first top plate 2211. The first top plate 2211 is provided with a switch arm 2213. The switch arm 2213 has a strip-shaped elastic arm 2214. The elastic arm 2214 is extended frontward and downwardly from a substantially middle portion of a front edge of the first top plate 2211, which is substantially opposite to an insertion direction of the audio plug connector. A free end of the elastic arm 2214 has a portion bent to form a first contacting portion 2215 of smooth V shape, for resting against the inserted audio plug connector. The two opposite lateral plates 2212 have two mating openings 223, passing therethrough and facing to each other. One of the lateral plates 2212 has a first soldering strip 2216 extended opposite to the first top plate 2211 from a bottom edge thereof.

Please refer to FIG. 2 and FIG. 3 again, the fixing terminal 222 has a rectangular second top plate 2221 and a pair of second lateral plates 2222 extended perpendicularly downwards from two opposite sides of the second top plate 2221. The second top plate 2221 is formed with a pair of cantilever switch slices 2225 and has a portion concaved upwards to form an indention area 2223. The indention area 2223 has a notch 2224 at a front end thereof. The switch slices 2225 have respective connecting portions 2226 extended toward each other and perpendicular to an extending direction of the switch arm 2213 from two opposite sides of the notch 2224. Each of the connecting portions 2226 has a free end extended upwards and oppositely to the connecting portion 2226 to form a second contacting portion 2227. Free ends of the contacting portions 2227 are spaced away from each other. A bottom surface of each of the second contacting portions 2227 is formed with a contacting lump 2228. The top plate 2221 further has two fixing apertures 224 adjacent to the first lateral plate 2222 and corresponding with the fixing lump 18 of the base 11. Each of the lateral plates 2222 has a mating opening 223 corresponding with the jamming lump 19 and a second soldering strip 2229. The second soldering strip 2229 extends outwardly opposite to the second top plate 2221 from a bottom edge of the lateral plate 2222.

The cap 30 has a covering plate 31. An upper portion of a side the covering plate 31 has a buckling slice 32. A lower portion of the side the covering plate 31 is protruded perpendicularly and outwardly to form two hooks 33, with originated ends thereof opposite to each other, for buckling with the hooking grooves 15.

Please refer to FIGS. 1-4, in assembly, the audio terminals 211 and the charging terminals 212 are respectively received into the first grooves 16 and the second grooves 17. The elastic terminal 221 is fixed to the insulating housing 10 by the mating openings 223 at the first lateral plates 2212 engaged with the corresponding jamming lumps 19. The switch arm 2213 is received in the channel 114, with the first contacting portion 2215 thereof projecting into the passageway 111. The two fixing apertures 224 are coupled with the fixing lumps 18 of the base 11 for positioning the fixing terminal 222, and the mating openings 223 of the second lateral plates 2222 are buckled with the corresponding jamming lumps 19, which makes the fixing terminal 222 fix to the insulating housing 10. Herein, the indention area 2223 is arranged above the channel 114 and the second contacting portions 2227 of the switch slices 2225 suspends over the first contacting portion 2215 of the switch arm 2213. The contacting lumps 2228 of the second contacting portions 2227 are spaced away from the first contacting portion 2215, with a gap formed therebetween. When the audio plug connector is inserted into the passageway 111 of the insulating housing 10, the first contacting portion 2215 is pushed upwards to contact at least one of the contacting lumps 2228 for forming an electrical connection between the elastic terminal 221 and the fixing terminal 222. The cap 30 is coupled on the insulating housing 10. The buckling slice 32 is received into the buckling recess 14, and the hooks 33 are buckled with the hooking grooves 15 for fixing the cap 30 to the insulating housing 10.

As described above, the fixing terminal 222 has two switch slices 2225 for contacting the switch arm 2213 of the elastic terminal 221. When the audio plug connector deflects in the passageway 111 to make the switch arm 2213, which restrains against the audio plug connector, deviate from original position, the switch arm 2213 still contact at least one of the switch slices 2225, which can form successive electrical connections between the fixing terminal 222 and the elastic terminal 221, consequently, insures steady transmission of the audio signals.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector adapted for mating with an audio plug connector, comprising:

an insulating housing having a rectangular base, the base having a passageway passing therethrough for receiving the inserted audio plug connector, a channel formed at a top surface of the base for communicating with the passageway;

a set of conductive terminals received in the insulating housing; and a set of switch terminals mounted to the insulating housing comprising an elastic terminal and a fixing terminal, the elastic terminal having a first top plate covered on the top surface of the base, and a switch arm extended outwards from the first top plate, with a free end thereof projecting into the passageway through the channel, the fixing terminal having a second top plate disposed above the channel, the second top plate having a pair of cantilever switch slices extending toward each other and perpendicular to an extending direction of the switch arm, with free ends thereof suspended over the free end of the switch arm and spaced from each other, wherein when the audio plug connector is inserted into the passageway, the free end of the switch arm is pushed to contact at least one of the free ends of the switch slices for forming an electrical connection between the fixing terminal and the elastic terminal.

2. The audio jack connector as claimed in claim 1, wherein the first top plate has two opposite sides extending downwards to form two first lateral plates, each of the first lateral plates has a mating opening corresponding to a jamming lump formed at each of two opposite sides of the base, for fixing the elastic terminal to the insulating housing.

3. The audio jack connector as claimed in claim 1, wherein the second top plate has two opposite sides extending downwards to form two second lateral plates, each of the second lateral plates has a mating opening corresponding to a jamming lump formed at each of two opposite sides of the base, for fixing the fixing terminal to the insulating housing.

4. The audio jack connector as claimed in claim 1, wherein the top surface of the base has two fixing lumps arranged at two sides of the channel, the second top plate has two fixing apertures engaging with the fixing lumps of the base for positioning the fixing terminal.

5. The audio jack connector as claimed in claim 1, wherein the switch arm has a strip-shaped elastic arm, the elastic arm is extended frontward and downwardly from a substantially middle portion of a front edge of the first top plate, which is substantially opposite to an insertion direction of the audio plug connector, a free end of the elastic arm has a portion bent to form a first contacting portion of smooth V shape, for resting against the inserted audio plug connector.

6. The audio jack connector as claimed in claim 1, wherein the second top plate has a portion concaved upwards to form an indention area, the indention area has a notch at an end thereof, the switch slices have respective connecting portions extended toward each other from two opposite sides of the notch.

7. The audio jack connector as claimed in claim 6, wherein the connecting portions have free ends bent upwards and extended successively toward each other to form second contacting portions, spaced away from each other.

8. The audio jack connector as claimed in claim 7, wherein a bottom surface of each of the second contacting portions is formed with a contacting lump.

* * * * *